US005127134A

United States Patent [19]

Demuth et al.

[11] Patent Number: 5,127,134

[45] Date of Patent: Jul. 7, 1992

[54] METHOD AND APPARATUS FOR CARDING MACHINE HEAT REMOVAL

[75] Inventors: Robert Demuth, Nurensdorf; Daniel Erni, Frauenfeld; Peter Fritzche, Winterthur, all of Switzerland

[73] Assignee: Maschinenfabrik Rieter AG, Winterthur, Switzerland

[21] Appl. No.: 622,619

[22] Filed: Dec. 5, 1990

[30] Foreign Application Priority Data

Dec. 6, 1989 [CH] Switzerland ..... 4371/89

[51] Int. Cl.[5] ..... D01G 15/08; D01G 15/24

[52] U.S. Cl. ..... 19/102; 19/98; 19/104; 19/107

[58] Field of Search ..... 19/99, 102-104, 19/107, 110, 111, 113, 114

[56] References Cited

U.S. PATENT DOCUMENTS

| | | | |
|---|---|---|---|
| 2,284,750 | 6/1942 | Landreth | 19/83 |
| 4,198,731 | 4/1980 | Harrison | 19/107 |
| 4,227,285 | 10/1980 | Hamrick | 19/107 |
| 4,353,149 | 10/1982 | Demuth et al. | 19/107 |
| 4,364,153 | 12/1982 | Beneke et al. | 19/107 |
| 4,434,531 | 3/1984 | Mondini | 19/99 |
| 4,499,632 | 2/1985 | Varga | 19/98 |

FOREIGN PATENT DOCUMENTS

| | | | |
|---|---|---|---|
| 0077166 | 4/1983 | European Pat. Off. . | |
| 0167722 | 1/1986 | European Pat. Off. . | |
| 0340458 | 11/1989 | European Pat. Off. . | |
| 0388791 | 9/1990 | European Pat. Off. . | |
| 2508265 | 9/1976 | Fed. Rep. of Germany | 19/107 |
| 2833413 | 2/1979 | Fed. Rep. of Germany | 19/107 |
| 3835776 | 4/1990 | Fed. Rep. of Germany . | |
| 0648333 | 5/1964 | France | 19/107 |
| 0261609 | 8/1949 | Switzerland | 19/107 |
| 0390109 | 7/1965 | Switzerland . | |
| 0662804 | 10/1987 | Switzerland . | |
| 0443944 | 4/1975 | U.S.S.R. | 19/107 |
| 0003173 | of 1913 | United Kingdom . | |
| 1141672 | 1/1969 | United Kingdom | 19/107 |

OTHER PUBLICATIONS

European Search Report.

*Primary Examiner*—Werner H. Schroeder
*Assistant Examiner*—Ismael Izaguirre
*Attorney, Agent, or Firm*—Sandler, Greenblum & Bernstein

[57] ABSTRACT

A cooling system and method for a carding machine having covering elements covering the swift of the card and a revolving flats arrangement defining the main carding zone. Heat is removed from the covering elements and/or the revolving flats arrangement by passing a heat-receiving medium, such as a liquid or gas, through ducts formed in covering element segments and/or between adjacent flats of the revolving flats arrangement.

22 Claims, 6 Drawing Sheets

Fig. 7A
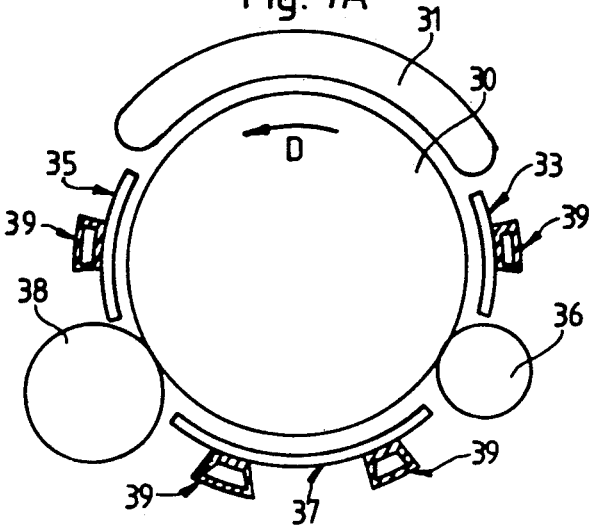
Fig. 7B
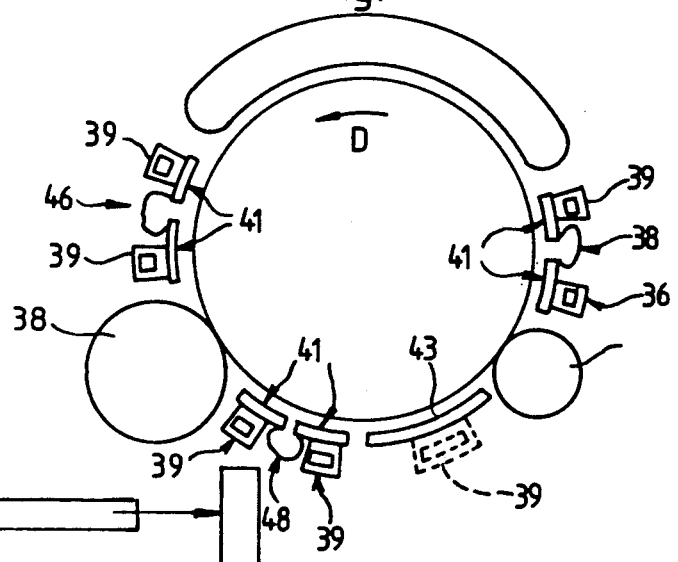
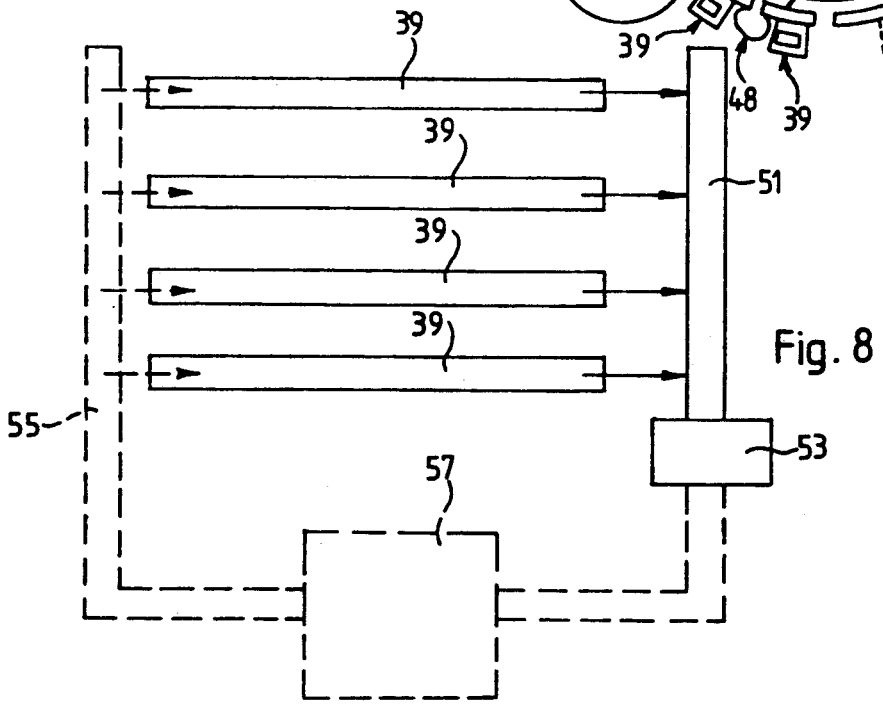
Fig. 8

METHOD AND APPARATUS FOR CARDING MACHINE HEAT REMOVAL

CROSS-REFERENCE TO RELATED APPLICATIONS

This application is related to commonly assigned U.S. patent application Ser. No. 07/621,841, entitled "Main Cylinder Casing Segment", filed on Dec. 4, 1990.

This application claims the priority of Swiss Application No. 04371/89-2 filed Dec. 6, 1989, which is incorporated herein by reference.

BACKGROUND OF THE INVENTION

1. Field of the Invention

The present invention is related to a cooling system for a card in which heat is removed from the swift covering and revolving flats.

2. Description of the Related Art

An object of modern carding methods is to increase throughput and production of material in a working area. Since mechanical work usually leads to the production of heat, changes of temperature are bound to create problems. In particular, the production of heat in the zone of operation of the card may lead to different heat expansions and excessive temperature differences between the card components.

These problems have already been recognized and have been described in European Patent Application No. 77 166, wherein the only provision for solving these problems is a liquid conveyance system in the swift to compensate for the temperature conditions on the outer periphery of the swift.

The only "access" to such a system is by way of the swift shaft; consequently, only very limited possibilities for acting on the conditions in such system exist so that the object of that invention (i.e., uniform temperature conditions) may prove to be unattainable.

SUMMARY OF THE INVENTION

The present invention proposes a card having means for removing heat from the swift (main cylinder) covering, and to a carding method, wherein carding heat is removed from the swift covering.

The invention differs from the prior art by various features, at least some of them having positive advantages, such as:

1. An object of the present invention is to remove and not just to distribute heat.
2. The swift covering is (at least as compared with the inside of the swift) readily accessible even during carding outside individual zones, and so a relatively less complex heat-removal system can be devised.
3. A system according to the present invention can be adapted to the heating in the working zone of the card, i.e., heat can be removed selectively from the card zones where it is produced during carding, thus helping to eliminate "hot zones";
4. When heat can be removed from the main working zones, the "air economy" of the card may be sufficient to ensure temperature equalization over the periphery of the swift.

The heat removal means may comprise at least one heat conductor in heat-exchanging relationship with at least a portion of the swift covering. The heat conductor can include a duct in which heat-receiving medium can flow. The heat-receiving medium can be pneumatic or hydraulic. Such means can, in operation, be incorporated in a heat removal system adapted to discharge the removed heat to a predetermined heat sink. Such a system can include a facility for producing a flow of the heat-removing medium in the duct. Such a system may also comprise, for example, flow-producing means such as a fan or a pump, and optionally a heat exchanger. A system of this kind can be combined, for example, with an air conditioning system or dust extraction system.

The heat conductor can be produced separately from the swift casing and be secured thereto at the required locations. Preferably, however, the or each heat conductor is incorporated in the swift covering. Appropriate covering elements for this purpose have been disclosed in our copending Swiss Patent Application No. 04 349/89-9, filed Dec. 4, 1989, entitled "Main Cylinder Casing Segments", corresponding to aforementioned U.S. patent application Ser. No. 07/621,841, the disclosure of which is hereby incorporated by reference thereto; particular constructions of such segments are shown in the drawings of the just mentioned Swiss application and U.S. applications as examples and will be described hereinafter.

Each heat conductor extends preferably axially over the whole working width of the swift. Heat can be removed in the direction of any one side or even both sides of the swift. An axially extending conductor is preferably of constant cross-section over its entire working width.

A duct-like heat conductor for a flowing medium can be constructed of a large number of adjacent swift covering elements (for example, flats), possibly together with an additional element for lateral closure of the duct.

The system of the present invention can be designed so that cooling is adapted to the particular pattern of heating, i.e., more heat is removed from those zones of the working area where the most heat is created during the operation. Such zones are, for example, those where carding work is performed, i.e., where fibers are processed between the card clothing of the swift and unfilled clothing of the covering elements. Cooling is less in zones where no carding work is performed.

According to one aspect of the present invention, a card includes a swift for conveying material in the card, wherein the swift includes covering means; means defining a main carding zone which may include an arrangement of revolving flats; and means for removing heat from at least one of the covering means and the means for defining a main carding zone.

The means for removing heat may include at least one heat conductor in heat-exchanging relationship with at least a portion of the at least one covering means and the means for defining a main carding zone. The heat conductor may be a duct for the flow of a heat-receiving medium, which may be a liquid or a gas.

According to another aspect of the invention, the means for removing heat may include a heat sink for removing heat from the heat-receiving medium, and a closed circuit for the flow of the heat-receiving medium.

According to still another aspect of the invention, the means for removing heat comprises at least one duct between adjacent flats of the arrangement of revolving flats, and heat receiving medium flowing in the duct. The arrangement of revolving flats comprises a plurality of T-shaped flats, at least one duct being located between adjacent flats, and a cover element which bridges inner ends of at least two adjacent flats.

The swift has a working width, and at least one duct extends over the whole working width. The covering means includes at least one segment, and at least one duct is incorporated in the segment.

Another object of the invention is to provide a carding method for a card, wherein the card comprises a swift, means covering the swift, and means defining a main carding zone. The carding method comprises the step of removing heat from at least one of the covering means and the means for defining a main carding zone. The method also includes revolving an arrangement of flats in the main carding zone, and passing a heat-receiving medium between at least two of the flats to remove heat from the means defining a main carding zone.

According to another aspect of the invention, heat-receiving medium is also passed through at least one duct to remove heat from the covering means. The duct extends over the whole working width of the swift.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIGS. 7A and 7B are diagrammatic side views of a card which explain an underlying principle of the present invention;

FIG. 8 is a diagrammatic view of a cooling system based on the principle illustrated in FIGS. 7A and 7B.

DETAILED DESCRIPTION OF THE PREFERRED EMBODIMENTS

Figure 1:
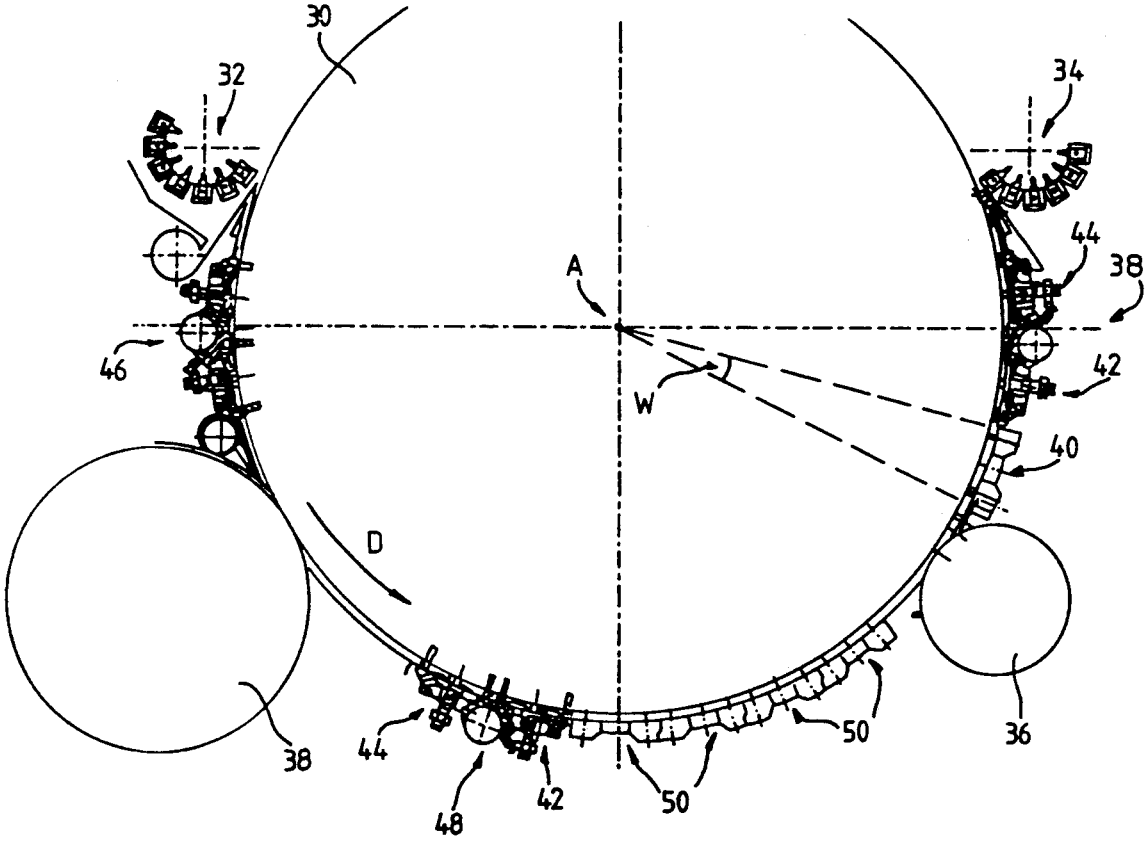
FIG. 1 is a diagrammatic view of a card having swift covering segments according to the present invention.

FIG. 1 is a diagrammatic view in side elevation of a swift or main carding cylinder 30 of a card. End parts 32, 34 of a revolving flats arrangement 31 define a main carding zone (see FIG. 5). A licker-in 36 and a doffer 38 are positioned adjacent swift 30. Swift 30 rotates around its axis A in the direction indicated by arrow D.

A waste separator 38' and a swift covering segment 40 preceding waste separator 38' are disposed in the pre-carding zone, i.e., between the licker-in 36 and the delivery end 34 of the flats arrangement. The waste separator 38' comprises two swift covering segments 42, 44 which will be described in greater detail below.

The after-carding zone, i.e, the zone between entry end 32 of the flats arrangement and the doffer 38, includes another waste separator 46 which is substantially the same as separator 38' and therefore will not be described in detail.

Disposed in the undergrid zone, i.e., the zone between the doffer 38 and the licker-in 36, is another waste or trash separator 48, which is substantially the same as the two separators 38, 46. Segment 50, which is located in the undergrid zone, is of substantially the same construction as segment 40.

An underlying principle of the present invention will now be described with reference to FIGS. 7A and 7B, and preferred arrangements will be described in greater detail with reference to other figures. FIGS. 7A and 7B also show in purely diagrammatic form the swift 30, which rotates in direction D, and revolving flats arrangement 31, which moves in a direction R and is shown arranged in spaced relationship from and partially circumferentially surrounding the swift 30.

It is assumed in FIG. 7A that the pre-carding, after-carding and undergrid zones have been covered purely by simple sheet-metal members 33, 35, 37 likewise shown arranged in spaced relationship from and partially circumferentially surrounding the swift 30. According to the present invention, a "heat conductor" in the form of a duct is secured to at least one such sheet-metal member. It is also assumed in FIG. *7a* that each sheet-metal member has at least one duct 39 (the member 37 in the undergrid zone is shown having two such ducts). Each duct 39 extends axially over the whole width of the working zone of the card. The duct is so secured to the sheet-metal member that heat is transferred therefrom to the duct. As will be described in greater detail below with reference to FIG. 8, in operation, a medium (e.g., liquid or gas) flows through the duct so that the heat transferred thereto is removed by the medium.

FIG. 8 diagrammatically illustrates a cooling system including the ducts 39, an extraction tube 51, a fan for a pneumatic system or a pump 53 for a hydraulic system. A connection to extraction tube 51 is provided for each duct 39, and is diagrammatically indicated by arrows 55 in FIG. 8, and will be described hereinafter with reference to the remaining drawings.

When using a pneumatic system, the cooling air can be sucked in from the spinning shed and possibly returned to the ambient air by the fan. A hydraulic system requires a closed circuit as indicated by a return tube 51', shown in chain lines in FIG. 8. A heat exchanger 57 must be provided when using the closed hydraulic circuit, and the ambient air can act as heat sink. In cases in which it is not desirable to use the air of the spinning shed for "disposal" of the buildup of heat, the heat can be guided to a different heat sink, using known principles of heat technology for this purpose. The cooling system of FIG. 8 also can be incorporated in the air conditioning system of the spinning mill.

A pneumatic system can, of course, also include a closed circuit for the cooling air, in which case, a heat exchanger 57 would be necessary. The cooling system can therefore be isolated from the air of the spinning shed, which may be desirable either for the cooling system (fly-containing air from the spinning shed) and/or for the spinning shed (conditioned air).

The cooling system can be incorporated with the waste removal system of the card. Our European patent application No. 340 458 discloses, for example, means for removing dust from a card, by providing a mobile air-collecting line. Such line can be effective, for example, as an extraction tube 51 of FIG. 8.

The sheet-metal parts 33, 35, 37, which are stationary relative to the swift interior, are readily accessible. Correspondingly, the or each duct can have a complicated pattern over the outside surface of the particular sheet-metal part concerned, provided that no deformation of such parts is produced by an irregular temperature profile.

No work is actually being performed between the swift and such simple sheet-metal part. Accordingly, the production of heat in the corresponding zones of the working area of the card is relatively reduced. The sheet-metal parts serve merely as means for transferring the heat created in the carding zone, i.e., between the flats and the swift.

However, this does not apply to a system of the kind shown in FIG. 1. FIG. 7B illustrates a simplified version of the waste system, each trash separator being represented by two carding segments 41 and the undergrid zone being represented by a sheet-metal covering 43. Since carding work must be performed between the swift and the carding segments 41, heat is created in the corresponding zones of the working area. Each segment 41 therefore includes a duct 39, so that the created heat can be directly removed. It may in some circumstances then be possible to delete heat transfer from the sheet-metal covering 43 but such transfer can be provided as indicated in chain lines.

Figure 5:
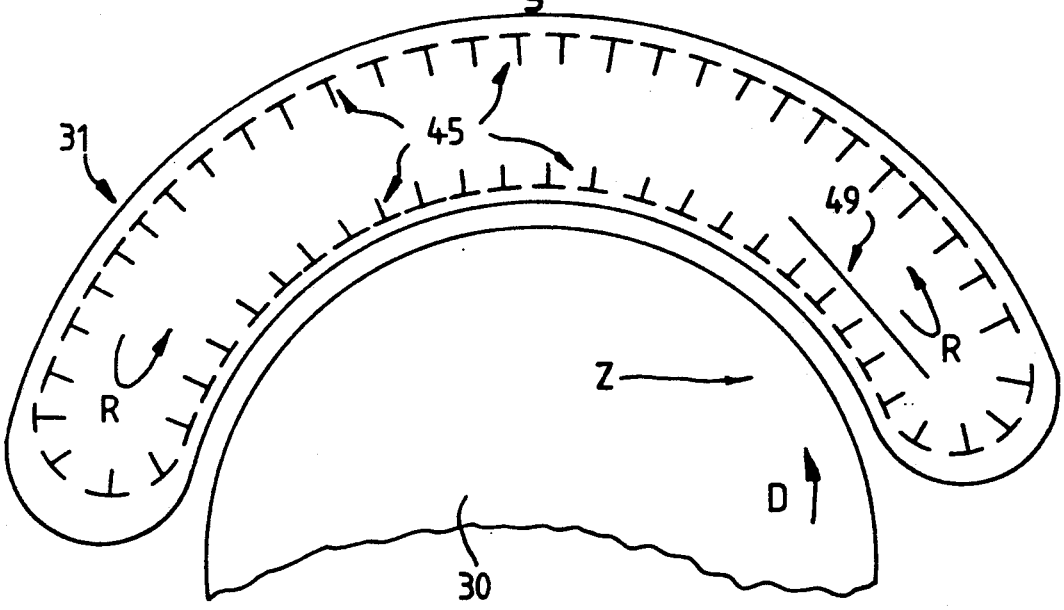
FIG. 5 is a diagrammatic view of an arrangement of revolving flats.
Figure 6:
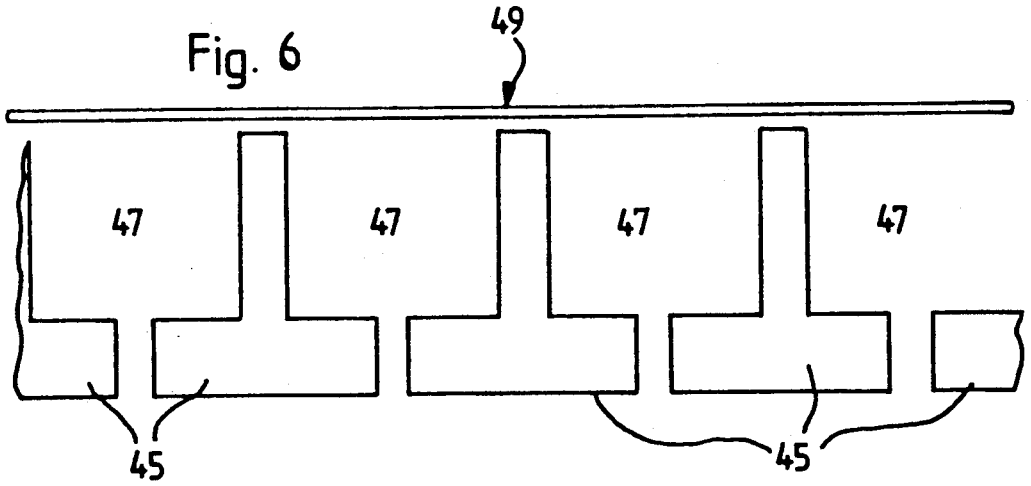
FIG. 6 is a diagrammatic view of a modified arrangement of FIG. 5.

In both cases shown in FIGS. 7A and 7B, heat is created in the revolving flats arrangement 31 and heat transfer from the zone of the arrangement 31 would be advantageous. FIGS. 5 and 6 diagrammatically illustrate an appropriate system for this purpose.

FIG. 5 diagrammatically illustrates a revolving flats arrangement having a large number of discrete T-shaped flats 45, each carrying clothing (not shown). The flats 45 are secured to endless carriers (not shown) and all move in direction R. FIG. 6 illustrates the ducts 47 being positioned between adjacent flats 45, and the ducts may include, for example, a cover element 49 which bridges the inner ends of the flats 45. In operation, flow of, for example, a gaseous medium, through the ducts 47 can be produced for the removal of heat.

It is not necessary for ducts 47 to be located between all the flats 45 of the arrangement. Most of the carding work is performed by the first flats above the material entry (licker-in 36), i.e., in the zone Z (FIG. 5). It is normally sufficient to remove the heat from 6 to 12 flats in zone Z (including the flat at the zone entry end). Therefore, element 49 can be correspondingly short.

All the proposed steps require the provision of an additional element, as described below. The segments which are shown in the aforementioned co-pending Swiss and U.S. applications, which will be described hereinafter with reference to FIG. 2, enable heat-removing ducts to be initially incorporated in the swift covering.

Figure 2:
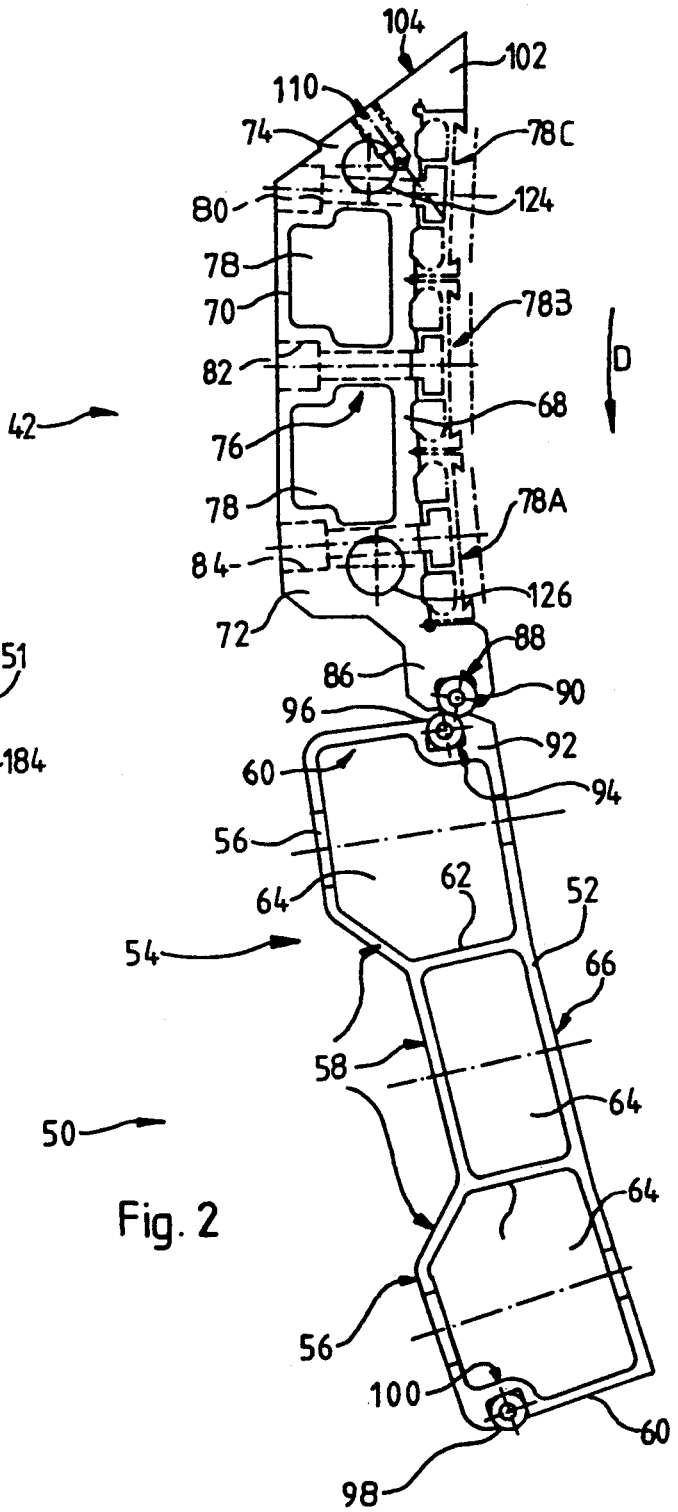
FIG. 2 illustrates swift covering elements for a card according to the present invention.

FIG. 2 illustrates the consecutive segments 50, 42 in an enlarged scale. The relatively simple segment 50 includes a first plate-like member 52 and a second plate-like member 54 comprising two planar side members 56 and a bent central member 58. The members 52, 54 are interconnected by way of side walls 60 and intermediate walls 62 so as to form three longitudinal ducts 64. The segment extends with a constant cross-section over the whole width (axial length) of the swift 30 and is secured by appropriate means (to be described hereinafter) to the card side plates (of the card frame). The segment 50 is constructed of an extruded light metal section member, for example, of aluminum. The shape of the segment is such that the construction can be very thin-walled, yet ensure the requisite rigidity of the segment over the entire working width. The segment wall thickness can be, for example, in the region of from 2 mm to 8 mm.

Segment rigidity is important to ensure that a setting of the fiber-guiding surface 66 relative to the clothing on the swift remains very constant over the entire working width once the apparatus is set up. The surface 66 forms the outer generated surface of the working zone of the card over an angular zone W (FIG. 1), corresponding to the segment 50, of the pre-carding zone. The zone W is shown in FIG. 1 for the substantially identical segment 40 and for the significance of such a zone, reference should be made to commonly assigned German Patent Application No. 3,865,776. The stiffening of the member 52 which is provided by the member 54 enables the member 52 to be adjusted to within close tolerances despite the thin-walled construction, which helps to save weight and material.

The relatively complicated segment 42 includes an inner plate-like member 68 and an outer plate-like member 70. The members 68, 70 are interconnected by a side wall 72, a side wall 74 and an intermediate wall 76 to form two longitudinal ducts 78. The segment 42 is produced as a light-metal extruded section member. This construction ensures that the segment 42 enjoys the advantages of reduced weight and enhanced rigidity.

The segment 42 does not serve directly as a fiber-treating element, but as carrier for the actual operative elements to be secured to the member 68. The latter elements are known in art and so will not be described in detail herein. They comprise, for example, three bars or rods 78A, 78C, 78C (shown in chain lines) which are secured by screws (not shown) to the member 68. The fixing screws (not shown) for the top bar 78C extend through a number of bores 80 (shown in chain lines, only one bore 80 being visible in FIG. 2) in side wall 74. Similarly, there is a row of bores 82 in the intermediate wall 76 for fixing screws for the central bar 78B. The side wall 72 is also formed with a number of bores 88 to receive fixing screws for the bottom bar 78A. The three bars can each include fiber-treating clothing as disclosed, for example, in Swiss Patent No. 662,804. The clothing can be, for example, pin clothing or sawtooth clothing, or just a structured surface according to commonly assigned Swiss Patent Application No. 1092/89, which corresponds to European Patent Application No. 0388791 and the cognate U.S. Pat. No. 5,004,170, granted Apr. 2, 1991.

The foundation surfaces for the three bars on the member 68 are so adapted to swift curvature that at optimum adjustment of the segment, the width of each bar extends substantially perpendicularly to a respective swift radius.

The side wall 72 includes an extension 86 formed with a longitudinal groove 88 in the surface facing segment 40. Groove 88 receives an elastomeric sealing element 90 which, for example, is a hollow member. The segments 50, 42, and 40, 42 are so positioned beside one another on the card that sealing element 90 is in contact with a lip 92 on the respective segment 50, 40. Each segment 50, 40 is formed with a longitudinal groove 94 adjacent the lip 92 and includes its own sealing element 96 which contacts sealing element 90 of the segment 42. Leakage flows between the segments (50), 40, 42 can therefore be substantially eliminated, ensuring improved control of air over the working zone of the card. This arrangement also helps to reduce soiling of the swift surroundings.

Where two fiber-guiding segments 50 are disposed in end-to-end relationship with one another, for example, in the undergrid zone, the gaps between adjacent segments can be sealed. The sealing element 96 (described above) can perform this function as can also another sealing element 98 (FIG. 2) which is disposed in a groove 100 which extends in the opposite direction as compared with groove 94.

Wall 74 includes an extension 102 having a surface 104, which is inclined to the radial plane of the swift. Surface 104 can be effective as a support surface for a waste-separating knife. The waste separator includes an extraction duct in the form of a tube extending over the entire working width of the card. The operation of this waste separator is known in the art and will not be described in greater detail herein.

The suspension of the various elements on the card frame is described with reference to FIGS. 3 and 4. Segments 40, 50 can readily be secured to the frame by fixing screws (not shown) which co-operate with bores in the end parts of the segments. The segment can be produced so accurately and with such rigidity that more complicated adjusting means are unnecessary. However, a special suspension with adjusting means has been devised for the segments 42, 44, as will be described below with reference to FIGS. 3 and 4.

Figure 3:
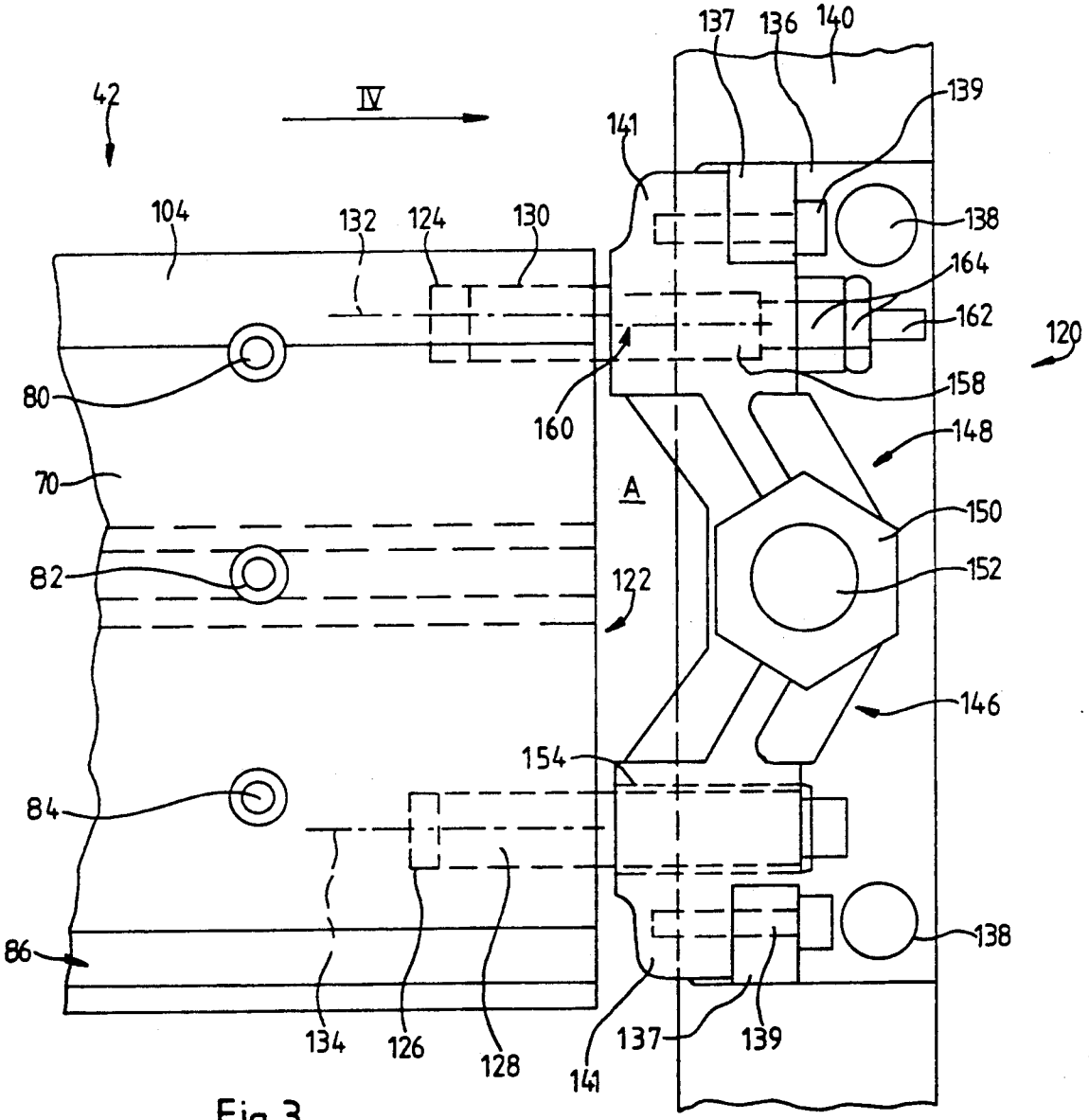
FIG. 3 is a diagrammatic plan view of an end part of a segment of FIG. 2, together with a suspension therefor.
Figure 4:
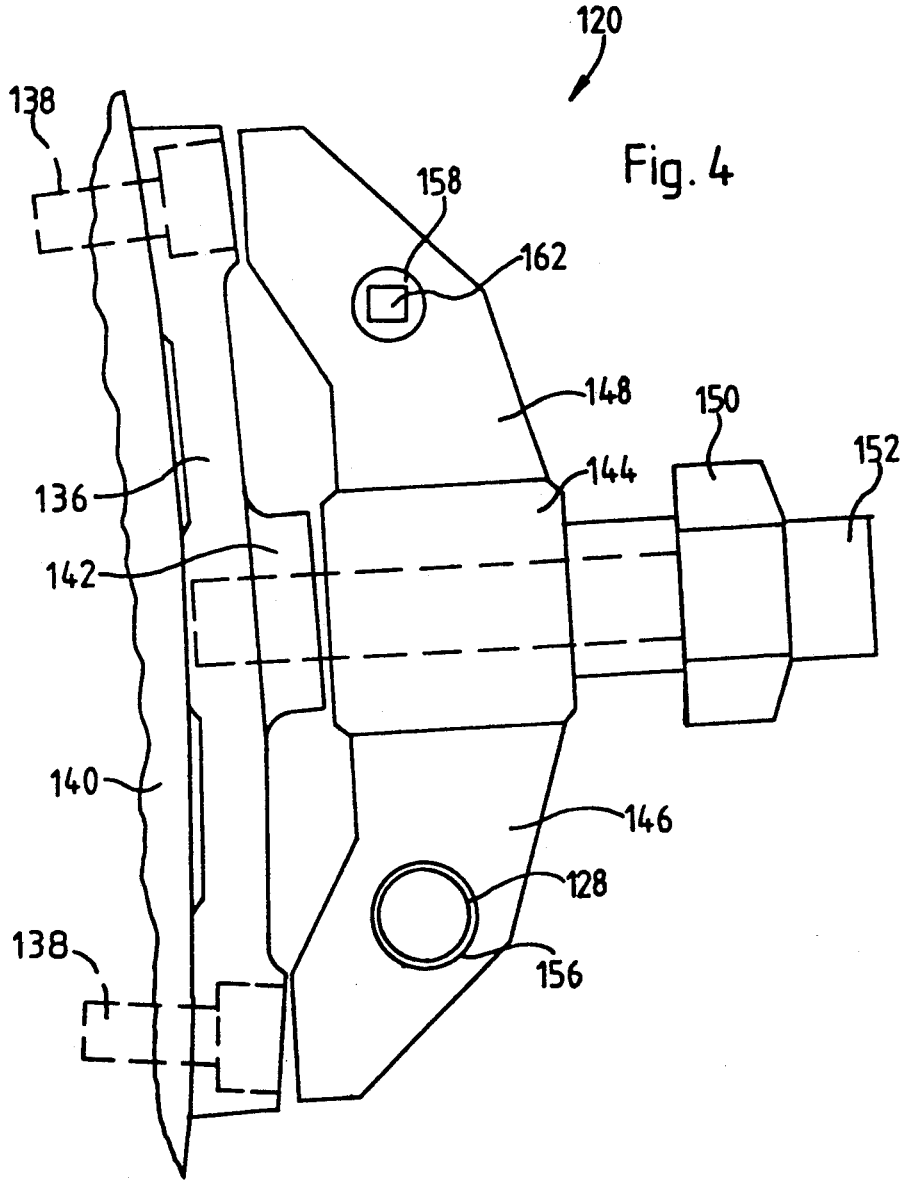
FIG. 4 is a diagrammatic side view of the suspension taken in the direction of arrow IV of FIG. 3.

FIG. 3 illustrates an end member of segment 42, together with the corresponding suspension which is generally designated by reference number 120. FIG. 4 shows the suspension itself, looking in the direction of arrow IV in FIG. 3. End face 122 of segment 42 is formed with two bores 124, 126 which extend lengthwise of the segment. A pin 128 is pressed into the bore 126 and thus assembled in the segment 42. The other bore 124 is adapted to receive a second pin 130 forming a part of the suspension 120 as will be described in greater detail hereinafter. The other segment end member (not shown) is formed with two bores coaxial with a respective bore 124, 126 to define two longitudinal axes 132, 134. The suspension 120 (see also FIG. 4) comprises a fixing plate 136 secured by screws 138 to a bearing plate 140 of the card. Plate 140 includes a hub 142 formed with a bore (not shown) which extends radially of the swift and which includes a screw thread.

Suspension 120 also comprises an adjuster including a hub part 144 and two wings or the like 146, 148. Hub part 144 includes a tapped continuous bore 144' with a corresponding hollow adjusting screw 150. The annular end face 151 of the screw 150 abuts the hub 142 of the plate 136. A fixing screw 152 extends through the continuous bore in the screw 150 in order to work in conjunction with the screw thread of the hub 142. Once the screw 152 has been loosened, the adjustment of the hub part 144 relative to the plate 136 can be altered by turning the screw 150. The new setting can then be fixed by means of the fixing screw 152.

The wing 146 includes a slide bearing 154 to receive pin 128. The wing 148 includes a plain bearing to receive a pin 158 which is integral with the pin 130 but whose longitudinal axis 160 is offset from the axis 132 so that the pins 130, 158 together form an eccentric adjusting device. The pin 158 includes an extension 162 for co-operation with an adjusting tool and with lock nuts 164.

To readjust the screw 150, the two pins 128, 130 are moved relatively to the swift in substantially radial directions. This adjustment can be carried out, for example, by means of an appropriate gauge, so that the clothing of the rod 78A (in the case of FIG. 2) which is near the pin 128 is at a required distance from the swift clothing. Very probably, however, the clothing of the other two rods 78B, 78C are then not at the required distance from the swift clothing. However, the pin 128 can be secured in this position by operation of the fixing screw 152. The required setting of the other rods is achieved by turning/adjusting device 130, 158, the spindle 130 rotating around axis 134. Since axis 134 is disposed vertically above the center of rod 78A, operation of the eccentric does not have a substantial effect on the adjustment of rod 78A. The complete adjustment can be fixed by means of lock screws 139 which extend through lugs 137 of the plate 136 into end parts 141 of the two wings 146, 148. The lugs 137 are formed With slot-like continuous bores to receive the screws.

Figure 9:
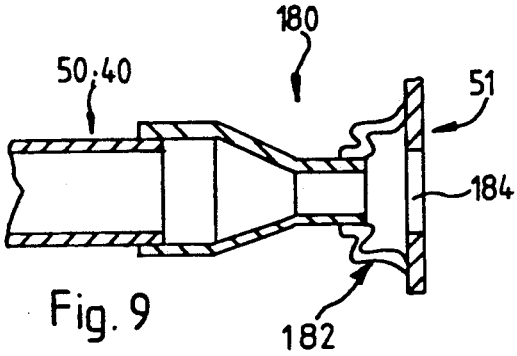
FIG. 9 is a diagrammatic view of a connection between a segment illustrated in FIG. 2 and the system of FIG. 8.

FIG. 9 diagrammatically illustrates a connection between, on one hand, a segment 50 of FIG. 2 or 40 of FIG. 2 and, on the other hand, the extraction tube 51 of FIG. 8. An adapter 180 provided for each segment 50, 40 is adapted to be connected at one end to the segment and includes at its other end a resilient sealing element 182. This arrangement forms a seal with the adapter 180 and with the extraction tube 51, the sealing element 182 extending around an entry aperture 184 in tube 51.

In the case of segments 50 placed end to end as in FIG. 1, a collecting transition can be provided between the section members and the extraction tube. Similarly, and as shown in FIG. 6, a collecting main can be provided between the ducts 47 and the extraction tube 51 in the zone of the flats.

The problems with the segments 42 are more difficult to solve since the latter co-operate at their ends with the suspensions 120. However, adapters (not shown) can extend either through the aperture A of FIG. 3 in the end face 122 of the segment 42 and in the suspension 120, or through the aperture B in FIG. 4 between the fixing plate 136 and that side of suspension 120 which is near the plate 136. The apertures A and B can be enlarged for this purpose.

The invention is not limited to the examples shown. Heat could of course be removed from the swift covering by cooling air flowing over the outside surface thereof; this flow could be separated from the spinning shed air by an external end casing of the machine. However, the deliberate removal of heat from selected zones of the machine (more particularly where carding work is being performed) will prove much more effective.

The present disclosure relates to subject matter contained in Swiss Patent Application No. 04 371/89-2 (filed Dec. 6, 1989) and the cognate U.S. application Ser. No. 07/622,619, filed Dec. 5, 1990, which is herein incorporated by reference in its entirety.

Although the invention has been described with reference to particular means, materials and embodiments, it is to be understood that the invention is not limited to the particulars disclosed and extends to all equivalents within the scope of the claims.

What is claimed is:

1. A card comprising:

(a) a swift for conveying material in the card;

(b) means at least partially circumferentially surrounding said swift and arranged in spaced relation with respect to said swift; and (c) means for removing heat from said circumferentially surrounding means.

2. The card according to claim 1, wherein said means at least partially circumferentially surrounding said swift and arranged in spaced relation with respect to said swift comprises an arrangement of revolving flats defining a carding zone.

3. The card according to claim 1, wherein said means for removing heat comprises at least one heat conductor in heat-exchanging relationship with at least a portion of said circumferentially surrounding means.

4. The card according to claim 3, wherein said at least one heat conductor comprises a duct for the flow of a heat-receiving medium.

5. The card according to claim 4, wherein said heat-receiving medium is a liquid.

6. The card according to claim 4, wherein said heat-receiving medium is a gas.

7. The card according to claim 4, wherein said means for removing heat includes a heat sink for removing heat from said heat-receiving medium.

8. The card according to claim 7, further comprising a closed circuit for the flow of said heat-receiving medium.

9. The card according to claim 4, wherein said swift has a working width, said at least one duct extending over said whole working width.

10. The card according to claim 4, wherein said circumferentially surrounding means includes at least one segment, said at least one duct being incorporated in said at least one segment.

11. The card according to claim 1, wherein at least a portion of said circumferentially surrounding means comprise stationary covering means.

12. The card according to claim 1, wherein at least a portion of said circumferentially surrounding means comprise revolving flat means defining a carding zone.

13. The card according to claim 1, wherein said circumferentially surrounding means are devoid of balancing means.

14. The card according to claim 1, wherein said circumferentially surrounding means are arranged about and in coacting relationship with predetermined discrete regions of the circumference of the swift, and said means from removing heat from said circumferentially surrounding means serve to cool said predetermined discrete regions of the circumference of the swift.

15. A card comprising:

(a) a swift for conveying material in the card, said swift including covering means;

(b) means defining a main carding zone;

(c) means for removing heat from at least one of said covering means and said means for defining a main carding zone;

(d) said means for defining a main carding zone comprises an arrangement of revolving flats; and (e) said means for removing heat comprises at least one duct between adjacent flats of said arrangement of revolving flats, and heat receiving medium flowing in said at least one duct.

16. The card according to claim 15, wherein said arrangement of revolving flats comprises a plurality of T-shaped flats, said at least one duct being located between adjacent flats.

17. The card according to claim 16, further comprising a cover element which bridges inner ends of at least two adjacent flats.

18. A carding method for a card, said card comprising a swift, means at least partially circumferentially surrounding said swift and arranged in spaced relation from said swift, said carding method comprising the step of removing heat from said circumferentially surrounding means.

19. The carding method according to claim 18, comprising the steps of:

providing as said means at least partially circumferentially surrounding said swift and arranged in spaced relation from said swift an arrangement of flats defining a carding zone, and revolving said arrangement of flats in said carding zone.

20. A carding method for a card, said card comprising a swift, means covering said swift and means defining a main carding zone, said carding method comprising the steps of removing heat from at least one of said covering means and said means for defining a main carding zone, revolving an arrangement of flats in said main carding zone, and passing a heat-receiving medium between at least two of said flats to remove heat from said means defining a main carding zone.

21. The carding method according to claim 18, comprising passing a heat-receiving medium through at least one duct to remove heat from said covering means.

22. The carding method according to claim 21, comprising extending said at least one duct over the whole working width of said swift.

* * * * *